US006126499A

United States Patent [19]

Katayama et al.

[11] Patent Number: 6,126,499

[45] Date of Patent: Oct. 3, 2000

[54] OIL PAN ARRANGEMENT FOR FOUR CYCLE OUTBOARD MOTOR

[75] Inventors: Goichi Katayama; Sadato Yoshida, both of Hamamatsu, Japan

[73] Assignee: Sanshin Kogyo Kabushiki Kaisha, Hamamatsu, Japan

[21] Appl. No.: 09/050,512

[22] Filed: Mar. 30, 1998

[30] Foreign Application Priority Data

Mar. 28, 1997 [JP] Japan ..... 9-077497

[51] Int. Cl.[7] ..... B63H 21/38

[52] U.S. Cl. ..... 440/88; 123/196 W; 440/89

[58] Field of Search ..... 440/88, 89; 123/196 W, 123/196 R; 184/106

[56] References Cited

U.S. PATENT DOCUMENTS 4,498,875 2/1985 Watanabe ..... 440/88

5,934,960 8/1999 Katayama et al. ..... 440/89

7,315,291 12/1995 Mashita et al. .

*Primary Examiner*—Sherman Basinger

*Attorney, Agent, or Firm*—Knobbe, Martens, Olson & Bear LLP

[57] ABSTRACT

A four cycle outboard motor that have water cooled engines and an oil pan that is formed in the upper portion of the drive shaft housing. An exhaust pipe collects exhaust gases from an exhaust guide and delivers to a cavity that is formed in the oil pan by an interior wall thereof. The exhaust pipe does not terminate below the lower surface of the oil pan and idle exhaust gases are delivered to the area between the exterior of the exhaust pipe and the interior surface of the oil pan that defines the cavity. These idle exhaust gases are discharged to the atmosphere through and above the water exhaust gas discharge. The oil pan lower surface has a drain opening that is aligned with a vertical drain opening in the drive shaft housing.

1 Claim, 5 Drawing Sheets

OIL PAN ARRANGEMENT FOR FOUR CYCLE OUTBOARD MOTOR

BACKGROUND OF THE INVENTION

This invention relates to a four-cycle outboard motor and more particularly to an improved oil pan arrangement for such outboard motors.

Because of environmental and other reasons, the more conventionally utilized two-cycle engines in outboard motors are being replaced by four-cycle engines. Many of the problems attendant with the design and construction of outboard motors become magnified when utilizing four-cycle engines.

Obviously, one of the main design criteria for an outboard motor is provide a compact yet efficient and high output system. This is one reason why two-cycle engines have been previously employed for these applications. The two-cycle engine, because of its firing of every rotation of the crank shaft tends to have a higher specific output then a like displacement four-cycle engine.

As noted above, however, certain factors are increasing the desire to utilize four-cycle engines for outboard motors. Thus, in addition to the normal problems of providing an effective exhaust system and good silencing, it is also necessary to incorporate an oil reservoir for the lubricating system of the four-cycle engine.

In order to provide a large oil reservoir and still a compact low center of gravity for the outboard motor, it is generally a practice to position the oil pan for the engine lubricating system on the underside of the exhaust guide. The exhaust guide is positioned at the upper end of the drive shaft housing and lower unit and supports the engine on its upper surface. The exhaust guide also attaches one or more exhaust pipes for delivering exhaust gases to the drive shaft housing for silencing an eventual discharge to the atmosphere.

When the oil pan for the engine is mounted in the drive shaft housing and lower unit, this presents certain problems in connection with servicing. That is, because of the recirculation of the lubricating oil, it should be changed at regular intervals.

Arrangements have been provided that permit the lubricant to be drained without removing the oil pan from the outboard motor. These generally employ arrangements wherein the oil pan has a portion that is positioned in proximity to the drive shaft housing. This oil pan portion has a drain plug that communicates with the exterior of the outboard motor through an opening in the drive shaft housing.

Because of the fact that the exhaust gases, particularly idle exhaust gas discharge must also be discharged to the atmosphere at a point high in the drive shaft housing, the idle exhaust gas discharge and the oil pan drain concepts compete with each other for space.

This has resulted in an arrangement wherein the drain for the oil pan is not positioned on the lower wall of the oil pan. Rather, there is a inclined rear wall and the drain is positioned in this inclined wall. This has several disadvantages.

First, because the drain is not in the lower wall, not all of the oil will be drained when it is changed. Furthermore, the inclined location makes it difficult to catch the drained oil and without some spillage.

These problems will be evident with the following description of the prior art type of constructions which are shown in partial detail in FIG. 1 which is a partial view of a prior art type of outboard motor, indicated generally by the reference numeral 31 and shows primarily the oil pan arrangement and the association of the oil pan with the exhaust system.

The conventional outboard motor 31 includes a power head, which is not shown but which extends above an exhaust guide 32 that is fixed and supported in a suitable manner across the upper end of a drive shaft housing unit, indicated generally by the reference numeral 33. This exhaust guide 32 has an exhaust passage 34 that communicates with the discharge end of an exhaust manifold of a four cycle internal combustion engine which is supported in the aforenoted power head and which is not illustrated.

An exhaust pipe 35 has a flanged portion 36 that is affixed to the underside of the exhaust guide 32 by threaded fasteners 37. The exhaust pipe 35 has an inlet end that is configured to be complementary to the exhaust guide exhaust passage 34 so as to collect the exhaust gases and deliver them downwardly to an expansion chamber 38 that is formed in the drive shaft housing lower unit 33.

The engine, which as has been noted is not shown, is of the four-cycle type. Therefore, there is provided an oil pan or oil reservoir 39 that is mounted on the underside of the exhaust guide 32 in a suitable manner and which contains lubricant for the engine.

This oil pan 39 is formed with an oil drain arrangement 41 that includes a drain plug 42 that is tapped into a threaded opening in an inclined lower wall 40 of the oil pan 39. A sealing gasket 43 surrounds the drain plug 42 and the drain plug is accessible through an access opening 44 formed in the drive shaft housing 33. This permits the lubricant to be drained from the oil pan 39 without its removal from the outboard motor 31. The drain plug 42 extends through an inner wall 45 of the drive shaft housing 33 and which is surrounded by a cowling portion 46.

However for several reasons including the exhaust arrangement to be described the wall 40 is not the lowermost wall of the oil pan 39 and thus it is difficult to insure that it will be fully drained. This is particularly true if servicing is done when the outboard motor is attached to a watercraft. Also the inclination of the wall 40 requires an inclined drain path which makes it difficult to insure that the oil will not run onto the exterior surfaces of the motor during draining.

It should be seen that the oil pan 39 is formed with an inner wall 47 that surrounds the exhaust pipe 35. The lower wall of the oil pan 39 terminates well above the lower end of the exhaust pipe 35. This means that when the outboard motor 31 is operating at idle or trolling condition, the end of the exhaust pipe 35 may be quite close to the water level. If misfiring occurs, either accidentally or intentionally to control the speed of the engine, negative pressure pulses may exist in the exhaust pipe 35. The water may then be drawn upwardly into the exhaust system when this occurs, obviously not a desirable condition.

The exhaust gases from the expansion chamber 38 are discharged to the atmosphere through a conventional underwater high-speed exhaust gas discharge. This may include a known type of through-the-hub underwater discharge.

Under low speed and low loads, however, the exhaust gases are delivered to the atmosphere through an above-the-water exhaust gas discharge. This is done because the back pressure would be too high to permit the discharge of the exhaust gases through the main exhaust system.

This idle discharge system includes a restricted passage 48 that is formed in the upper part of the exhaust pipe 35. The exhaust gases pass through this opening 48 and are deflected away from the oil pan wall 47 by a baffle 49. The exhaust gases then flow downwardly as indicated by the arrow 51 to an area between the outer surface of the oil pan 39 and across the inclined wall 40 and an inner surface wall 52 of the drive shaft housing 45. These exhaust gases then flow upwardly and through a restricted passageway 53 in the wall 52 as shown by the arrow 54. The exhaust gases then pass into an expansion chamber 55 formed by a further wall and which then can flow to the atmosphere through an idle discharge passage 56 formed in the drive shaft housing 33 in the direction of the arrow 57.

A water drain 58 is formed at the lower end of the expansion chamber 55 so that water that may be entrapped with the exhaust gases 10 drains back to the body of water in which the watercraft is operating.

The engine, which is not shown, has a water cooling system that includes a cooling jacket through which coolant is circulated by a water pump in a known manner. This coolant is then discharged at least in part to a cooling jacket 59 formed in the exhaust guide 32 around the exhaust passage 34. This water then fills a weir type device surrounding the oil pan 39 for its cooling and is discharged downwardly through a drain passage 61 for discharge through the lower unit in a known manner.

SUMMARY OF THE INVENTION

The invention is adapted to be embodied in a four-cycle outboard motor that is comprised of a power head. An exhaust guide supports at least in part a four-cycle internal combustion engine in the power head. The exhaust guide is supported at the upper end of a drive shaft housing and lower unit that depend from the power head. A drive shaft driven by the engine is journaled within the drive shaft housing and lower unit and drives a propulsion unit therein for propelling an associated watercraft through a body of water. An oil pan is supported at least in part on the underside of the exhaust guide within the drive shaft housing and lower unit for containing lubricant for the engine. The oil pan defines an internal cavity which passes vertically therethrough. An exhaust pipe depends from the exhaust guide and receives exhaust gases from the engine for delivering them to the drive shaft housing and lower unit. The exhaust pipe extends through the oil pan internal cavity. The lowermost surface of the oil pan has a portion that is juxtaposed to a surface of the drive shaft housing and lower unit that defines a vertically extending opening. A drain plug is provided in this oil pan lowermost surface in alignment with the drive shaft housing and lower unit vertically extending opening for draining of the oil pan.

DETAILED DESCRIPTION OF THE PREFERRED EMBODIMENT

Figure 1:
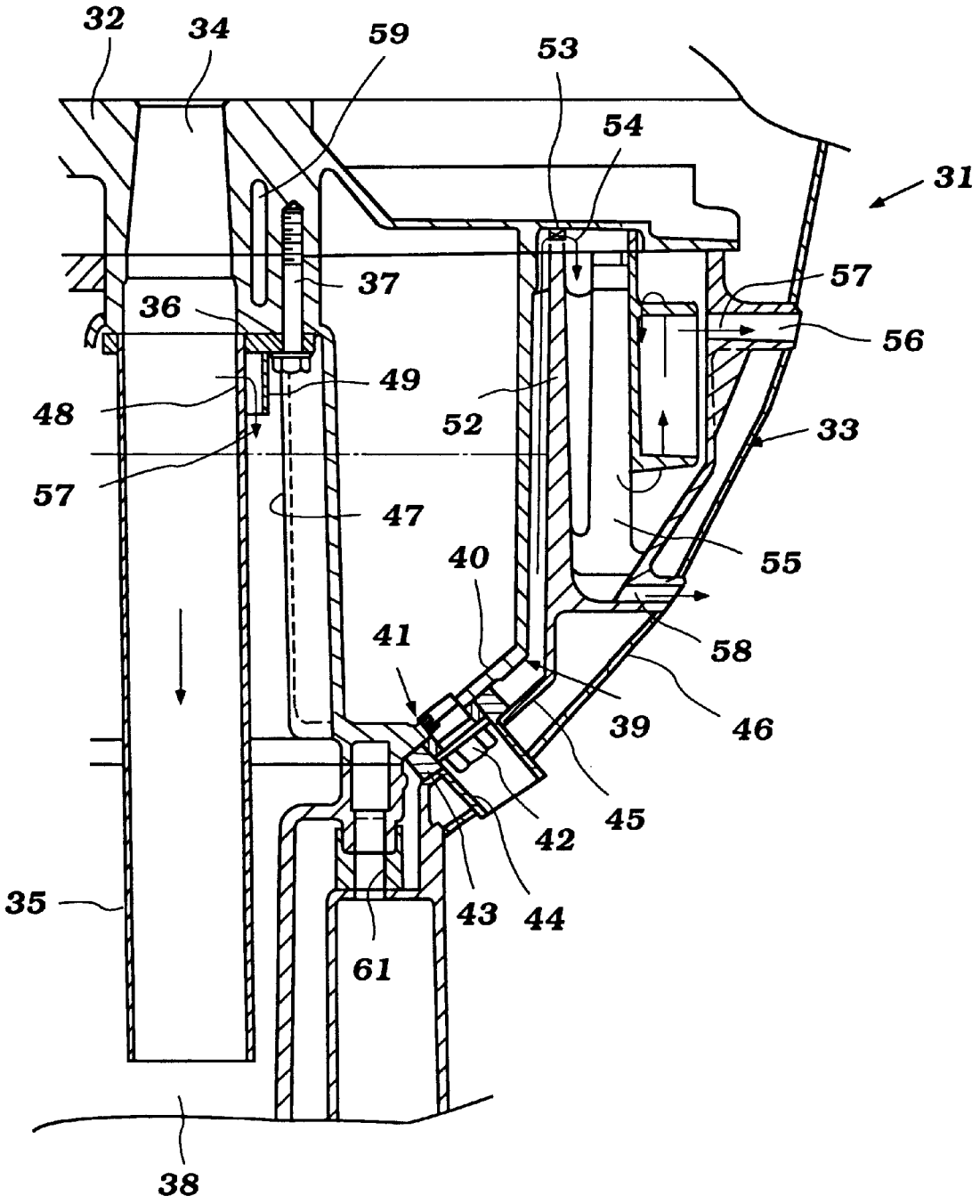
Figure 1 Prior Art
FIG. 1 is a partial cross-sectional view taken through an outboard motor constructed in accordance with a prior art type construction and which is illustrated in order to describe the problems of the prior art.

An outboard motor constructed in accordance with the preferred embodiment is shown in more detail in FIGS. 2–5 and is indicated generally by the reference numeral 101. The outboard motor 101 is comprised of a power head, indicated generally by the reference numeral 102. This includes an internal combustion engine, which is shown in phantom and which is identified generally by the reference numeral 103. In the specific embodiment illustrated, the engine 103 is a two cylinder, inline type of four cycle engine. Although the invention is described in conjunction with such an engine, it should be readily apparent that the invention can be utilized with engines having other cylinder numbers and other configuration. The invention does, however, have particular utility with four cycle engines because of their need for a separate lubricating system and lubricant reservoir within the outboard motor.

The power head 102 is completed by a protective cowling which encircles the engine 103. This protective cowling is comprised of a lower tray 104 preferably formed from a lightweight high-strength material such as aluminum or aluminum alloy. In addition, a main removable cowling member 105 is detachably connected to the tray 104 and encloses in substantial part the engine 103. The main cowling member 105 is formed preferably from a lightweight high-strength material. A molded fiberglass reinforced resin or the like is normally utilized for this purpose.

As is typical with outboard motor practice, the engine 103 is supported within the power head 102 so that its crankshaft 106 rotate about a generally vertically disposed axis. This is to facilitate a driving connection to a drive shaft 107 that is rotatably journaled in a suitable manner within a drive shaft housing and lower unit, indicated generally by the reference numeral 108. This drive shaft 107 depends downwardly into a lower unit portion 109 of the drive shaft housing and lower unit assembly 108. The drive shaft 107 there drives a propeller shaft 111 through a conventional bevel gear reversing transmission 112. A propulsion device such as a propeller 113 is fixed for rotation with the propeller shaft 111 for propelling an associated watercraft, to be described shortly, to which the outboard motor 101 is affixed in a manner which will also be described, through the body of water in which the watercraft is operating.

An exhaust guide 114 extends across and is affixed to the upper end of the drive shaft housing 108 in a known manner. The engine 103 is supported on this exhaust guide 114. The engine 103 has a suitable internal exhaust manifold that has a discharge end which mates with an exhaust passage 115 (FIGS. 2 and 3) of the exhaust guide 114. An exhaust pipe 116 is affixed, in a manner to be described, to the lower end of the exhaust guide 114 and collects the exhaust gases. These exhaust gases are then discharged, in a manner which will be described, through an internal cavity formed in an oil pan, indicated generally by the reference numeral 117 and which has a construction as will be described.

The oil pan 117 contains lubricant for the engine 103. This lubricant is circulated by means of an oil pump 118 which is driven from the engine 103 in a suitable manner. For example, the oil pump 118 may be driven off the end of a cam shaft (not shown) of an overhead cam shaft mechanism for the engine 103.

Figure 2:
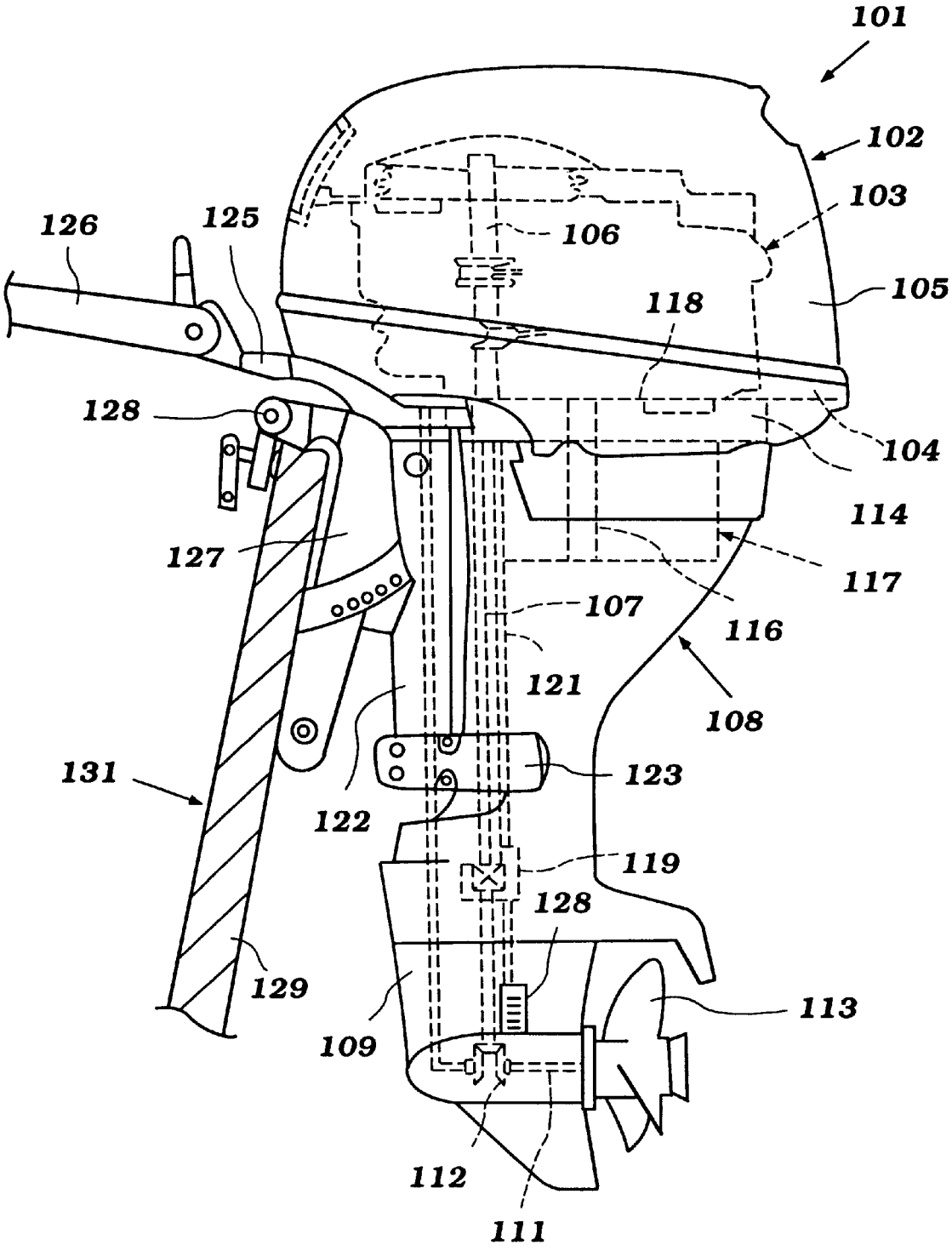
FIG. 2 is a side-elevational view of an outboard motor constructed in accordance with a preferred embodiment of the invention and shown attached to the transom of a watercraft which is shown only partially and in cross-section.

Continuing to refer primarily to FIG. 2, the engine 103 is also water-cooled. Coolant is circulated through the cooling jacket of the engine 103 by means of a water pump 119. The water pump 119 is mounted at the lower portion of the drive shaft housing 108 above the lower unit 109 and is driven by the drive shaft 107. A water inlet opening 120 in the lower unit 109 delivers water to the inlet side of the water pump 119.

This water is then pumped upwardly for circulation through the engine cooling jacket through a water delivery pipe 121, which will also be described in more detail later.

A steering shaft (not shown) is rotatably journaled within a swivel bracket 122. This steering shaft is connected to the drive shaft housing and lower unit assembly 108 by a lower mounting bracket 123 and an upper mounting bracket. The mounting brackets 123 and upper mounting assembly in cooperation with the swivel bracket support the steering shaft for steering movement of the outboard motor 111 about a vertically extending steering axis defined by the swivel bracket 122.

The steering shaft has affixed to its upper end a tiller 125 to which a pivoted tiller control 126 is mounted for control of the outboard motor's steering position.

The swivel bracket 122 is, in turn, affixed for pivotal movement to a clamping bracket 127 by a pivot pin 128. Pivotal movement of the swivel bracket 122 and, accordingly, the outboard motor 101 about the pivot pin 128 achieves tilt and trim movement of the outboard motor 101, as is well known in this art.

The clamping bracket 127 is detachably connected by a suitable mechanism to a transom 129 of a watercraft 131. Hence, the outboard motor 101 will propel the watercraft 131 in a well-known manner through the body of water in which the watercraft operates.

Figure 3:
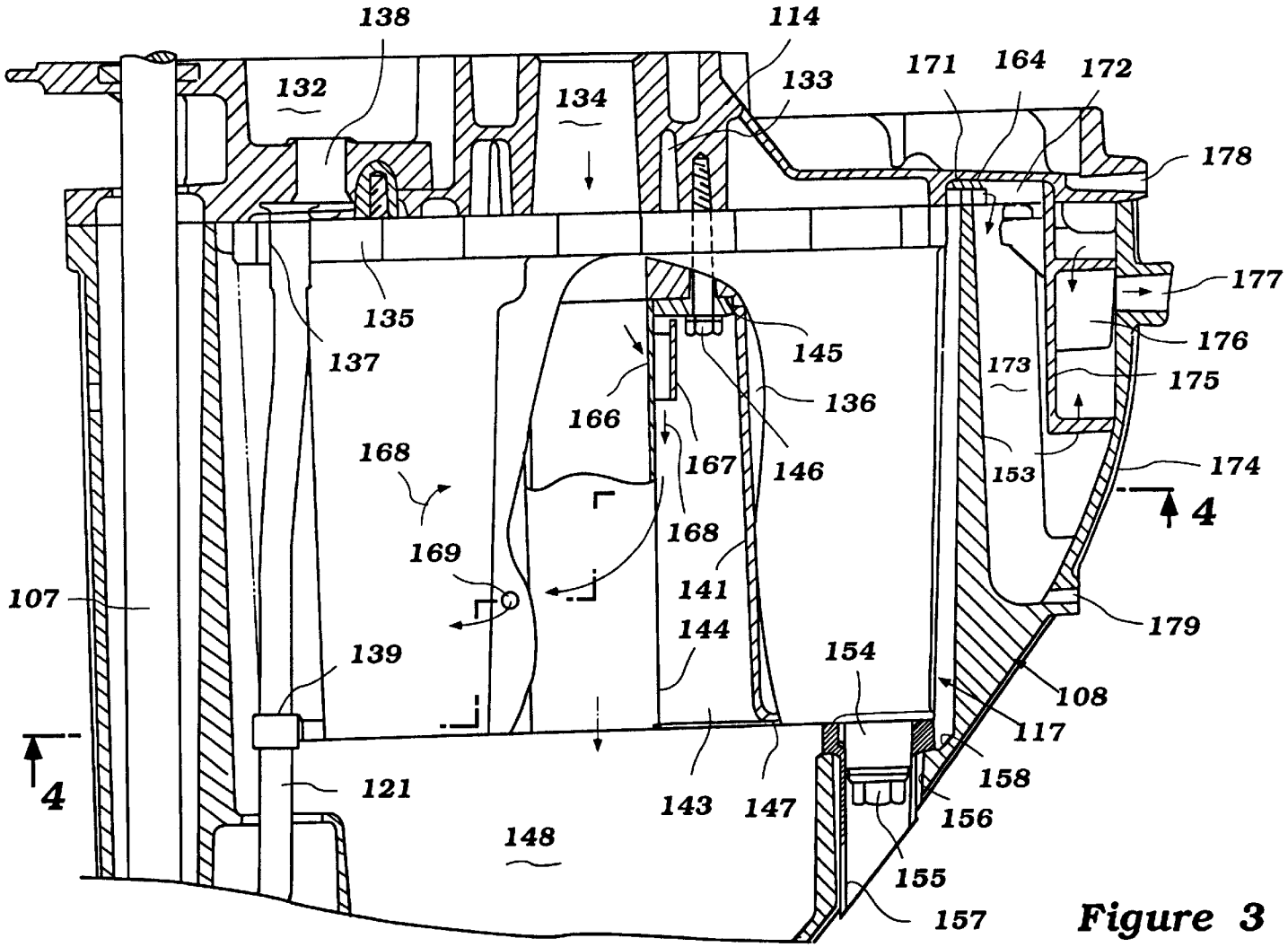
FIG. 3 is a cross-sectional view, in part similar to FIG. 1, but showing the preferred embodiment of the invention.
Figure 4:
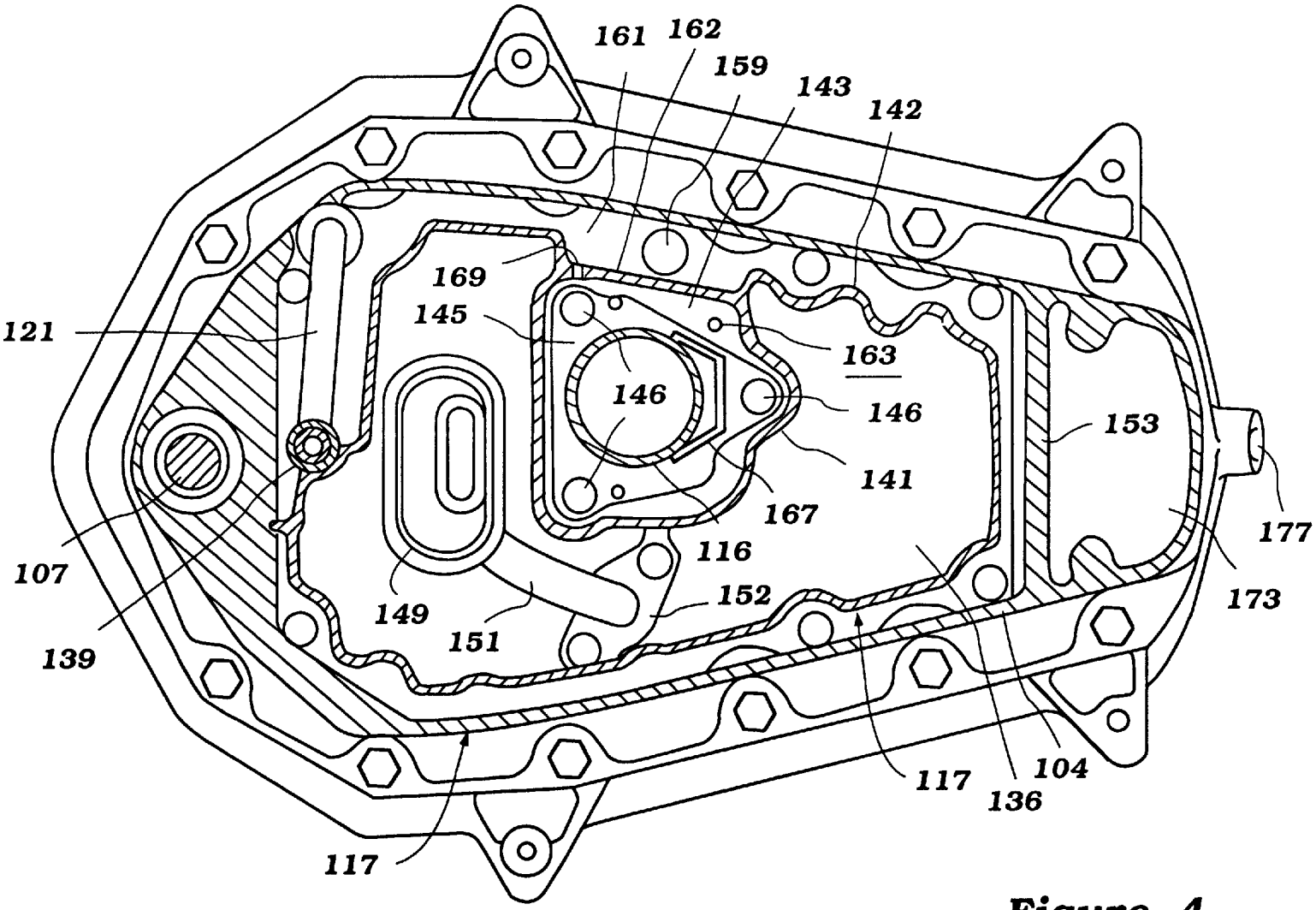
FIG. 4 is a partial cross-sectional view taken through the upper portion of the drive shaft housing and lower unit and is taken generally along the line 4—4 of FIG. 3.
Figure 5:
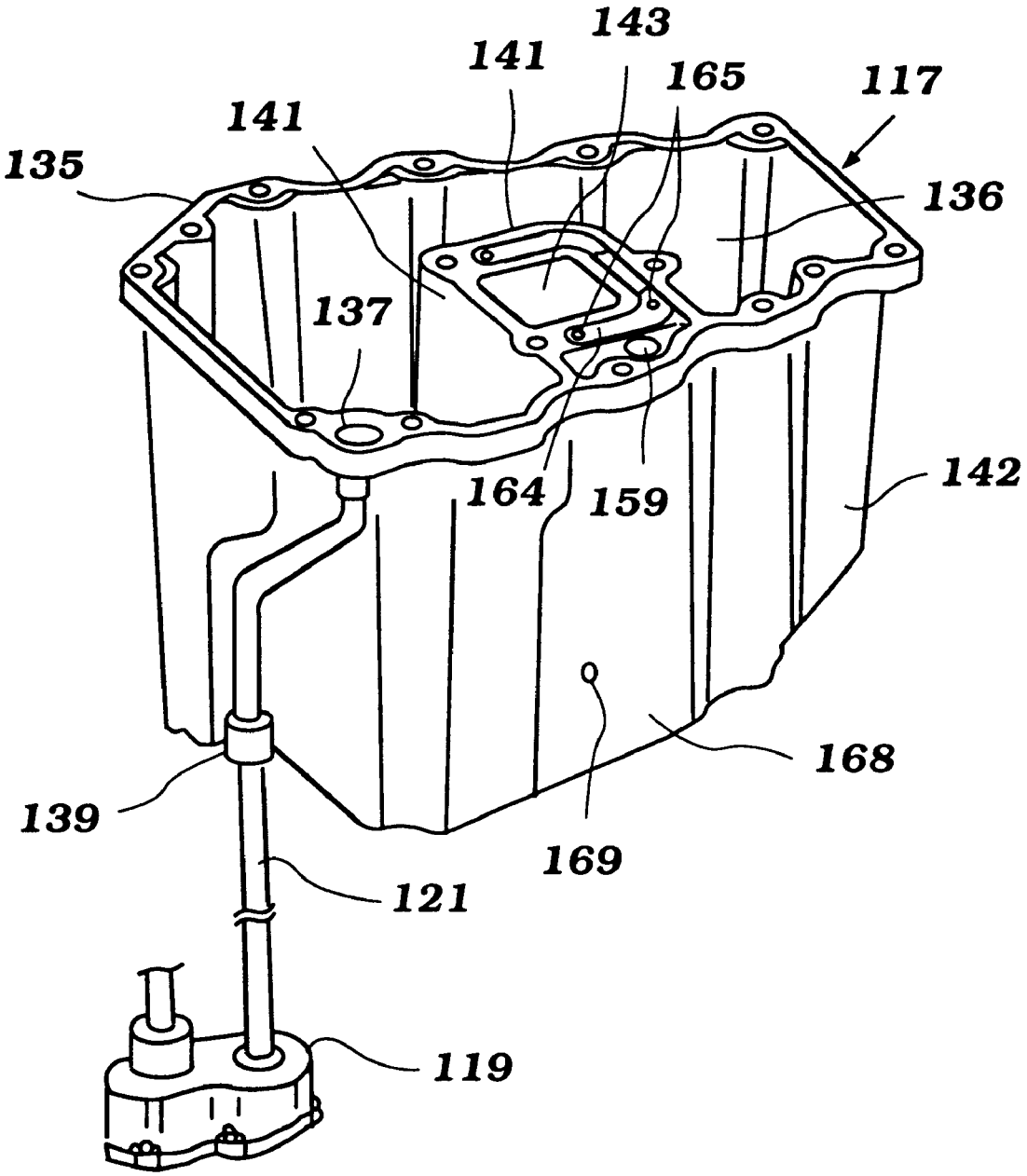
FIG. 5 is a perspective view showing the water pump and the oil pan of this embodiment.

Referring now primarily to FIGS. 3–5, it will be seen that the exhaust guide 114 is provided with a recessed cavity 132 that receives coolant from the conduit 121. This coolant is then delivered in a suitable manner to the cooling jacket of the engine 103. Returned water is delivered, at least in substantial part, to a water jacket 133 that surrounds the exhaust passage 115 in the exhaust guide 114. This water is returned to the body of water in which the watercraft 131 is operating in a manner which will be described later.

Referring first to the construction of the oil pan 117, this construction is shown perspective view in FIG. 5. The oil pan 117 has an upper peripheral flange 135 that has a number of openings so as to provide a means by which it is attached to the underside of the exhaust guide 114. As may be also seen in the figures, the oil pan 117 is defined by upstanding outer peripheral walls that define an oil receiving chamber 136.

At one corner of the flange 135, there is provided an opening 137 to which the upper end of the conduit 121 delivers its coolant. This passage 137 communicates with the exhaust guide water chamber 132 through a short passage 138. At the lower end of this outer peripheral wall, a connector 139 or hose retainer is provided that holds the intermediate end of the conduit 121 against vibration.

The oil chamber 136 is defined on its inner peripheral edge by a further upstanding wall 141 which is integrally formed with the oil pan 117 and is spaced inwardly from the outer peripheral wall 142, except for a portion, as will be noted later. This defines a generally vertically extending passage or chamber 143 through which the exhaust pipe 116 extends.

As best seen in FIG. 3, the exhaust pipe 116 is formed at its upper end with an outer peripheral flange 145 which is fixed to the exhaust guide 114 by elongated threaded fasteners 146. This configuration leaves an air gap between the outer peripheral edge of the exhaust pipe 116 and the inner surface of the wall 141 so as to provide for some heat insulation between the exhaust pipe 116 and the oil pan 117.

In addition, this space may act as an expansion chamber, in a manner which will be described, so as to provide silencing for the exhaust gases. It should be noted that the lower end of the exhaust pipe 116 in this embodiment terminates at a point which is not substantially below a lower wall 147 of the oil pan 117. As has been previously noted, more conventional structures extend the exhaust pipe much below this area and, therefore, there is a likelihood that water might be able to enter into the exhaust system.

The exhaust pipe 116 terminates at its lower end with an expansion chamber 148 that is formed in the drive shaft housing 108 and thus the exhaust gases can be silenced by expansion in this expansion chamber and then discharged to the atmosphere through a suitable underwater exhaust gas discharge system, which can utilize a through the hub exhaust, of the type previously noted.

It has been noted that the lubricant is drawn from the oil pan by the oil pump 118. A strainer 149 depends into a lower surface of the oil pan 117 and is connected by means of a conduit 151 to a flange 152 that is mounted to the underside of the exhaust guide 114. This communicates directly with the inlet side of the oil pump 118 in any suitable manner.

It should be noted that the rearward end of the oil pan 117 extends rearwardly adjacent an upstanding integral wall 153 of the drive shaft housing 108. The lower portion of the oil pan 117 is formed with a drain nipple 154 which has an axial extent that is parallel to the axis of rotation of the drive shaft 107 and thus is vertical.

A drain plug 155 is threadingly engaged in this drain nipple 154 and is accessible through a vertically extending opening 156 formed in the rearward portion of the drive shaft housing 108 just forward and adjacent the wall 153. A combined seal and protective tube 157 is interposed between the upper end of a ledge 158 formed forwardly of the wall 153 and the lower surface 147 of the oil pan 117. The combined seal and protective tube 157 has a flange portion that is sealingly engaged between the lower end of the oil pan 117 and the upper end of the ledge 158. This further includes a depending guide sleeve that is spaced inwardly from the opening 156 and which extends below the adjacent surface of the drive shaft housing 108 through which the opening 156 passes. This provides not only a seal but will also dampen vibrations and protect the components.

The way in which water is returned from the engine cooling jacket back to the body of water in which the water craft is operating will now be described in detail by continued reference primarily through FIGS. 3–5.

First, there is provided a main water drain passage 159 (FIGS. 4 and 5) that extends through the exhaust guide 114 and in the upper portion of the oil pan 117 which communicates with an outer peripheral volume 161 that extends between the outer peripheral wall 142 of the oil pan 117 and the inner peripheral wall of the drive shaft housing 108. This is on the outer surface of the oil pan 117 and thus provides further insulation and protection of the oil pan 117 from heat.

Also, the cooling water will flow across a portion 162 of the outer wall 142 which portion is not wetted on its internal surface by the oil in the reservoir volume 136. In other words, the oil reservoir volume 136 does not completely circle the inner wall 141 of the oil pan 117. This is the common portion with the inner wall as previously noted. Thus, the wall portion 162 is not wetted directly by the oil and this unwetted portion is in the vicinity of the water return 159.

A smaller water return path in the area of the inner wall 141 and around the periphery of the exhaust pipe 116 is provided by a weep passage 163. This passage 163 is covered on its upper portion by a shroud or seal 164 held in place by a pair of small threaded fasteners 165.

An above the water low speed idle exhaust gas discharge path will now be described also by reference to FIGS. 3–5. This is comprised of an idle exhaust gas discharge opening 116 that is formed in the upper portion of the exhaust pipe 116 adjacent the flange 145. This small opening is shielded by a baffle 167 which, in this embodiment, is affixed by welding to the outer peripheral edge of the exhaust pipe 116. The baffle 167 is interposed between the opening 161 and the weep passage 163 so as to ensure that water cannot enter the exhaust pipe in this area through the idle exhaust gas discharge 166.

Thus, when there is a high enough back pressure in the underwater exhaust gas discharge, exhaust gases may flow in the direction indicated by the arrows 168 through the exhaust pipe opening 166 and downwardly under the direction of the baffle 167 into the area 143. Thus, there is a contraction and expansion of these exhaust gases that will be provide a good silencing effect.

These exhaust gases then flow downwardly to a small opening 169 formed in the oil pan wall portion 162. Hence, this unwetted portion of the oil pan wall 162 affords an exhaust gas discharge which can be formed above the lower end of the exhaust pipe 116 and through which the exhaust gases for the above the water discharge can pass.

These exhaust gases then can flow upwardly through the cavity 161 between the drive shaft housing 108 and the outer wall 142 of the oil pan 117. Thus these gasses need not pass below the oil pan 117, as with prior art constructions. This permits the drain nipple 154 to be located as it is.

As may be seen best in FIG. 3, these exhaust gases can then flow through a restricted opening 171 formed in the upper portion of the wall 153 and defined between the shield 164 across a passage 172 that communicates with an expansion chamber 173 formed by the wall 153 of the drive shaft housing and an outer surface 174 thereof.

These exhaust gases can then flow through a baffle wall 175 into a further expansion chamber 176. This expansion chamber 176 communicates with and above the water idle exhaust gas discharge port 177 that is formed in the rear portion of the drive shaft housing wall 174. Thus, the idle exhaust gases have several expansions and contractions and are very effectively silenced without significant restriction. In addition, the arrangement is such that water is not likely to enter the exhaust pipe 144.

Some of the engine coolant may be discharged through a tell tale opening in the exhaust guide 114. Such an opening is identified at 178 in FIG. 3. This gives the operator a visual indication that the engine 103 is receiving coolant.

Some water may separate from the exhaust gases in the idle exhaust gas discharge.

This separation occurs primarily in the expansion chamber 173 due to the expansion that takes place therein. A drain passage 179 may be formed in the lower end of the chamber 173 so as to permit this separated water to drain.

Thus, from the foregoing description it should be readily apparent that the described construction permits the utilization of a fairly large oil tank without interference with the exhaust system. In addition, the drain arrangement for the oil tank permits the positioning of the oil drain plug on the lower most surface of the tank and the drain passage through the outer casing of the outboard motor extends vertically so that catching of the drained lubricant will be facilitated. In addition, staining of the outer casing is substantially avoided.

Of course, the foregoing description is that of a preferred embodiment of the invention and various changes and modifications may be made without departing from the spirit and scope of the invention, as defined by the appended claims.

What is claimed is:

1. A four-cycle outboard motor comprised of a power head, an exhaust guide supporting at least in part a four-cycle internal combustion engine in said power head, said exhaust guide being supported at the upper end of a drive shaft housing and lower unit that depends from said power head, a drive shaft driven by said engine journaled within said drive shaft housing and lower unit and driving a propulsion unit therein for propelling an associated watercraft through a body of water, an oil pan supported at least in part on the underside of said exhaust guide within said drive shaft housing and lower unit for containing lubricant for the engine, said oil pan defining an internal cavity which passes vertically therethrough, an exhaust pipe depending from said exhaust guide through said oil pan internal cavity and receiving exhaust gases from said engine for delivering them to said drive shaft housing and lower unit, the lowermost surface of said oil pan having a portion that is juxtaposed to a surface of said drive shaft housing and lower unit that defines a vertically extending opening, a drain plug is provided in said oil pan lowermost surface in alignment with said drive shaft housing and lower unit vertically extending opening for draining of the oil pan, and a guide sleeve extending through said drive shaft housing and lower unit vertically extending opening in spaced relation thereto, said guide sleeve having a flange portion clamped between said oil pan lower surface and said drive shaft housing and lower unit and a tubular portion extending below said drive shaft housing and lower unit vertically extending opening for draining of oil from said oil pan through said vertically extending opening without contacting said drive shaft housing and lower unit.

* * * * *